United States Patent [19]

Habeeb et al.

[11] Patent Number: 4,992,186

[45] Date of Patent: Feb. 12, 1991

[54] ENHANCING ANTIWEAR AND FRICTION REDUCING CAPABILITY OF CERTAIN MOLYBDENUM (V) SULFIDE COMPOUNDS

[75] Inventors: Jacob J. Habeeb; Morton Beltzer, both of Westfield, N.J.

[73] Assignee: Exxon Research and Engineering Company, Florham Park, N.Y.

[21] Appl. No.: 404,144

[22] Filed: Sep. 7, 1989

[51] Int. Cl.[5] ..... C10M 133/38; C10M 135/18

[52] U.S. Cl. ..... 252/47.5; 252/49.7

[58] Field of Search ..... 252/47, 49.7, 49.9, 252/47.5

[56] References Cited

U.S. PATENT DOCUMENTS 3,419,589 12/1968 Larson ..... 252/49.7

3,840,463 10/1974 Froeschmann ..... 252/32.7 E 4,308,182 12/1981 Eckard ..... 252/31 X 4,588,829 5/1986 Pan ..... 556/38

*Primary Examiner*—Jacqueline V. Howard

*Attorney, Agent, or Firm*—Joseph J. Dvorak

[57] ABSTRACT

It now has been discovered that lubricating compositions containing (disulfido) tris (N, N-substituted dithiocarbamato) Mo(V) compounds can be enhanced by the inclusion in the composition certain polydentate ligands. Thus, the present invention comprises a major amount of an oil of lubricating viscosity and a minor, but effective, amount of an antiwear and friction reducing additive consisting essentially of (disulfido) tris (N, N-substituted dithiocarbamato) molybdenum (V) compounds and polydentate ligands and mixtures thereof.

15 Claims, No Drawings

ENHANCING ANTIWEAR AND FRICTION REDUCING CAPABILITY OF CERTAIN MOLYBDENUM (V) SULFIDE COMPOUNDS

FIELD OF THE INVENTION

The present invention is concerned with improved lubricating compositions. More particularly, the present invention relates to lubricating compositions containing (disulfido) tris (N, N-substituted dithiocarbamato) molybdenum (V) compounds. Indeed, this invention is concerned with enhancing the antiwear and friction reducing capability of such molybdenum compounds by including in the composition mono and polydentate ligands.

BACKGROUND OF THE INVENTION

Molybdenum disulfide is a well-known lubricant additive. Because it is insoluble in lubricating oils, however, oil soluble sulfur containing molybdenum compounds have been proposed and investigated as lubricant additives. For example, in U.S. Pat. No. 2,951,040 an oil soluble molybdenum xanthate is disclosed as being useful in lubricating compositions. Apparently, the molybdic xanthate decomposes under conditions of use to form an oil insoluble solid molybdenum sulfide on the metal surfaces being lubricated.

U.S. Pat. No. 3,419,589 discloses the use of certain "sulfurized" molybdenum (IV) dialkyldithiocarbamates as lubricant additives. These additives are described as being oil soluble or at least capable of being easily suspended in oils.

U.S. Pat. No. 3,840,463 discloses the use of certain metal dialkyldithiocarbamates or dithiophosphates in combination with metal-free additives containing sulfur and phosphorus.

U.S. Pat. No. 4,588,829 discloses the use of (disulfido) tris (N, N-substituted dithiocarbamato) Mo(V) complexes in lubricant compositions.

SUMMARY OF THE INVENTION

It now has been discovered that lubricating compositions containing (disulfido) tris (N, N-substituted dithiocarbamato) Mo(V) compounds can be enhanced by including polydentate ligands in the composition. Thus, the present invention comprises a major amount of an oil of lubricating viscosity and a minor, but effective, amount of an antiwear and friction reducing additive consisting essentially of (disulfido) tris (N, N-substituted dithiocarbamato) molybdenum (V) compounds and a ligand selected from the group consisting of polydentate ligands and mixtures thereof.

In another embodiment of the present invention, a lubricating oil additive is provided which comprises a mixture of a (disulfido) tris (N, N-substituted dithiocarbamato) molybdenum (V) compounds and a ligand selected from polydentate ligands and mixtures thereof, in the mole ratio of molybdenum compound to ligand of from about 1:1 to about 1:4.

These and other aspects of the present invention will be readily appreciated after reference to the Detailed Description, which follows.

DETAILED DESCRIPTION OF THE INVENTION

An improved lubricating oil composition includes a (disulfido) tris (N, N-substituted dithiocarbamato) molybdenum (V) sulfide and a ligand selected from polydentate ligands and mixtures thereof.

(Disulfido) tris (N, N-substituted dithiocarbamato) Mo(V) sulfide compounds are disclosed in U.S. Pat. No. 4,588,829, which patent is incorporated herein by reference. These compounds may be represented by the formula $MoS_2(S_2CNR_2)_3$ where R is hydrogen, alkyl, aryl or cycloalkyl groups and in which each R may be the same or different.

In the practice of the present invention, at least some of the Rs in the $MoS_2(S_2CNR_2)_3$ compounds are selected from hydrocarbyl groups having a sufficient number of carbon atoms to render the compound soluble in the lubricating oil. Indeed, it is preferred that all the Rs be alkyl groups of from about 2 to about 20 carbon atoms. Especially preferred are alkyl groups of from about 6 to about 12 carbon atoms.

Those skilled in the art know that the term "ligand" is used to designate functional coordinating groups which have one or more pairs of electrons available for the formation of coordinate bonds. Monodentate ligands can form only one bond with a metal ion, while polydentate ligands can form more than one bond with a metal ion. Polydentate ligands have been found to enhance the antiwear and friction reducing properties of the $MoS_2(SCNR_2)_3$ lubricant additives. Polydentate ligands include triazole, dithiodipyridine, 2,2'-bipyridine, tetramethylethylene-diamine, etc. Particularly useful ligands in the practice of the present invention are nitrogen containing polydentate ligands that also have disulfide bonds like thiadiazoles and dithiodipyridine. Indeed, dithiodipyridine is most preferred.

The oil used in the composition of this invention may be selected from naturally occurring mineral oils or from synthetic oils. These oils may range in viscosity from light distillate mineral oils to heavy lubricating oils, such as a gas engine oil, mineral lubricating oil and their mixtures. In general, the viscosity of the oil will range from about 5 centistokes to 26 centistokes and especially in the range from about 10 centistokes to 18 centistokes at 100° C.

As previously stated, the lubricant composition of the present invention includes a major amount of an oil of lubricating viscosity and a minor amount of an antiwear and friction reducing additive consisting essentially of compounds having the formula $MoS_2(S_2CNR_2)_3$ and a ligand selected from polydentate ligands and mixtures thereof, where at least some of the Rs in the molybdenum compound are selected from hydrocarbyl groups having a sufficient number of carbon atoms to render the compound soluble in the oil. The mole ratio of molybdenum compound to ligand or mixtures thereof in the composition generally is between about 1:1 to about 1:4 and preferably from about 1:1 to about 1:2.

In general, the lubricant compositions will contain from about 0.01 to 5 weight percent of the additive based on the weight of lubricating oil and preferably in the range from about 0.1 to 1.0 weight percent. A particularly preferred lubricating oil composition will contain a major amount of a base lubricating oil and from about 0.1 to 1.0 weight percent based on the weight of oil of an additive consisting essentially of $MoS_2(S_2CN(C_8H_{17})_2)_3$ and dithiodipyridine in a mole ratio of from about 1:1 to about 1:4.

If desired, other known lubricant additives can be used for blending in lubricant compositions of this invention. These include ashless dispersants, viscosity improvers and the like. These can be combined in proportions known in the art.

The compositions of the present invention possess both antiwear properties and antifriction properties.

The invention will be more fully understood by reference to the following examples illustrating various modifications of the invention which should not be construed as limiting the claims herein.

Test Procedures

In the tests that follow, a number of lubricating oil compositions were evaluated for wear protection using the Four Ball Wear Test procedure (ASTM Test D-2266) and the ball on cylinder (BOC) test procedure. The Four Ball Wear Test procedure is well known and it will not be repeated here. The BOC test, also well known, was conducted by applying a force of 9.8 Newtons to a 12.5 mm still ball in contact with a rotating steel cylinder having 43.9 mm diameter and containing a sufficient quantity of lubricant to cover 2 mm of the bottom of the cylinder. The cylinder was rotated at 0.25 rpm. The frictional force was continuously monitored by means of a load transducer. In the tests conducted, friction coefficients attained steady state values after 7 to 10 turns of the cylinder.

COMPARATIVE EXAMPLES 1 TO 4

The samples tested in these comparative examples consisted of Solvent 150 neutral lubricating oil and the amounts of $MoS_2(S_2CN(C_8H_{17})_2)_3$ shown in Table 1. Results of the tests are also given in Table 1.

EXAMPLES 5 AND 6

The samples tested in these examples consisted of Solvent 150 neutral lubricating oil and the amounts of $MoS_2(S_2CN(C_8H_{17})_2)_3$ and dithiodipyridine shown in Table 1. Results of the tests are also given in Table 1.

COMPARATIVE EXAMPLES 7 AND 8

For comparative purposes, similar tests were conducted using just dithiodipyridine in the lubricating oil. Amounts and results are given in Table 1.

COMPARATIVE EXAMPLE 9

The tests were also conducted using just Solvent 150 neutral lubricating oil with the results shown in Table 1.

TABLE 1

| Run | % Additive(s) $MoS_2(DTC)_3$ | % Additive(s) Dithiodipyridine | Four Ball Wear Test $mm^3 \times 10^4$ | BOC Friction Coefficient |
|---|---|---|---|---|
| Comparative Example 1 | 0.45 | 0.0 | 18 ± 2 | 0.072 |
| Comparative Example 2 | 0.25 | 0.0 | 9 ± 0 | 0.095 |
| Comparative Example 3 | 0.15 | 0.0 | 60 ± 20 | 0.117 |
| Comparative Example 4 | 0.10 | 0.0 | 236 ± 174 | 0.100 |
| Example 5 | 0.10 | 0.02 | 10 ± 1 | 0.023 |
| Example 6 | 0.10 | 0.04 | 10 ± 0 | 0.017 |
| Comparative Example 7 | 0.0 | 0.05 | 5 ± 1 | 0.14 |
| Comparative Example 8 | 0.0 | 0.02 | 7 ± 2 | N/D |
| Comparative Example 9 | 0.0 | 0.00 | 545 ± 75 | 0.25 |

N/D = not determined
DTC = $SCN(C_8H_{17})_2$

EXAMPLES 10 AND 11

In these examples, the tests outlined above were repeated using Solvent 150 neutral lubricating oil containing $MoS_2(S_2CN(C_8H_{17})_2)_3$ and the ligand shown in Table 2. The respective amounts of additives and test results are also shown in Table 2.

TABLE 2

| Run | %, $MoS_2(DTC)_3$ | Ligand | % Ligand | BOC Four Ball Wear Test | Friction Coefficient |
|---|---|---|---|---|---|
| Example 10 | .10 | A | .06 | 31 ± 1 | 0.038 |
| Example 11 | .10 | B | .06 | 24 ± 6 | 0.037 |

DTC = $(S_2CN(C_8H_{17})_2)_3$
A = 2-dodecylthio-1,3,4-thiadiazole-5-thione
B = hydroxylethylthio-5-dodecylthio-1,3,4-thiadiazole

What is claimed is:

1. A lubricating oil composition comprising a major amount of an oil of lubricating viscosity and a minor amount of an additive comprising a compound of the formula $MoS_2(S_2CNR_2)_3$ and a ligand selected from polydentate ligands and mixtures thereof, wherein each R in the compound may be the same or different and is selected from hydrogen, alkyl, aryl and cycloalkyl groups and at least some of which have a sufficient number of carbon atoms to render the additive soluble in the oil, and wherein the mole ratio of compound to ligand is in the range of from about 1:1 to about 1:4.

2. The composition of claim 1 wherein the amount of the additive ranges from about 0.10 to about 1.0 weight percent based on the weight of oil.

3. The composition of claim 2 wherein the polydentate ligand is a nitrogen containing compound having disulfide bonds.

4. The composition of claim 3 wherein the ratio of compound to ligand is from about 1:1 to about 1:4.

5. The composition of claim 4 wherein each R in the compound is selected from alkyl groups of from about 2 to about 20 carbon atoms.

6. The composition of claim 5 wherein each R in the compound is an octyl group.

7. The composition of claim 6 wherein the ligand is a dithiodipyridine.

8. The composition of claim 6 wherein the ligand is a thiadiazole.

9. A method for improving the antiwear and antifriction properties of oil compositions containing an oil of lubricating viscosity and a (disulfido) tris (N, N-substituted dithiocarbamato) molybdenum (V) compound, comprising adding to the composition a ligand selected from polydentate ligands in amounts sufficient to provide a mole ratio of compound to ligand of from 1:1 to 1:4.

10. The method of claim 9 wherein the ligand is a nitrogen containing polydentate ligand including a disulfide group.

11. The method of claim 10 wherein the ligand is a dithiodipyridine.

12. The method of claim 10 wherein the ligand is a thiadiazole.

13. A lubricating oil additive comprising a mixture of a (disulfido) tris (N,N-substituted dithiocarbamato) molybdenum (V) compound and a ligand selected from polydentate ligands and mixtures thereof, the mole ratio of compound to ligand being in the range of from about 1:1 to about 1:4.

14. The oil additive of claim 13 wherein the ligand is a dithiodipyridine.

15. The oil additive of claim 13 wherein the ligand is a thiadiazole.

* * * * *